US007371054B2

(12) United States Patent
Shiina

(10) Patent No.: US 7,371,054 B2
(45) Date of Patent: May 13, 2008

(54) SWASH-PLATE COMPRESSION DEVICE OF VARIABLE CAPACITY TYPE

(75) Inventor: Masaki Shiina, Isesaki (JP)

(73) Assignee: Sanden Corporation, Gunma (JP)

( * ) Notice: Subject to any disclaimer, the term of this patent is extended or adjusted under 35 U.S.C. 154(b) by 673 days.

(21) Appl. No.: 10/793,041

(22) Filed: Mar. 5, 2004

(65) Prior Publication Data

US 2004/0191076 A1 Sep. 30, 2004

(30) Foreign Application Priority Data

Mar. 28, 2003 (JP) ..... 2003-090597

(51) Int. Cl.
*F04B 1/29* (2006.01)

(52) U.S. Cl. ..... 417/222.2

(58) Field of Classification Search ..... 417/222.1, 417/222.2, 269

See application file for complete search history.

(56) References Cited

U.S. PATENT DOCUMENTS

| | | | | |
|---|---|---|---|---|
| 5,486,098 | A * | 1/1996 | Kimura et al. | 417/222.2 |
| 6,389,824 | B2 | 5/2002 | Ota et al. | |
| 6,637,223 | B2 * | 10/2003 | Ota et al. | 62/158 |
| 2002/0094278 | A1 * | 7/2002 | Fukanuma et al. | 417/222.2 |

FOREIGN PATENT DOCUMENTS

| | | |
|---|---|---|
| EP | 1074800 | 2/2001 |
| EP | 1083335 | 3/2001 |
| EP | 1122431 | 8/2001 |
| EP | 1247981 | 10/2002 |
| JP | 2001107854 | 4/2001 |

OTHER PUBLICATIONS

Search Report issued by the French Patent Office dated Mar. 14, 2005.

* cited by examiner

*Primary Examiner*—Michael Koczo, Jr.
(74) *Attorney, Agent, or Firm*—Baker Botts L.L.P.

(57) ABSTRACT

A swash-plate compression device of the variable capacity type used in a refrigerating system of a vehicle comprises a swash-plate compressor and a control valve for autonomously adjusting the pressure in a crank chamber of the compressor. The control valve is opened and closed to introduce some of a refrigerant, which is discharged from the compressor, into the crank chamber. The opening of the control valve is controlled in accordance with a target differential pressure between the actual discharge pressure of the discharged refrigerant and the mean internal pressure of the entire compression chambers of the compressor or between the actual discharge pressure and the peak value of the internal pressure of the compression chamber so that the actual capacity of the compressor is feedback-controlled to be adjusted to a target capacity therefor.

6 Claims, 5 Drawing Sheets

SWASH-PLATE COMPRESSION DEVICE OF VARIABLE CAPACITY TYPE

This nonprovisional application claims priority under 35 U.S.C. 119(a) on Patent Application No. 2003-90597 filed in Japan on Mar. 28, 2003, the entire contents of which are hereby incorporated by reference.

BACKGROUND OF THE INVENTION

1. Field of the Invention

The present invention relates to a swash-plate compression device of the variable capacity type used for indoor air conditioning, and more particularly, to a compression device suited for use in an air conditioning system of a vehicle.

2. Description of the Related Art

A swash-plate compression device of this type is described in Jpn. Pat. Appln. KOKAI Publication No. 2001-107854, for example. This conventional compression device comprises a swash-plate compressor, which includes a crank chamber, a swash plate rotatable in the crank chamber, and a plurality of pistons that reciprocate as the swash plate rotates. The reciprocation stroke of each piston settles the capacity of the compressor.

On the other hand, the tilt angle of the swash plate, which settles the reciprocation stroke of each piston, is adjusted by means of the pressure in the crank chamber. Accordingly, the capacity of the compressor of this type can be varied by adjusting the pressure in the crank chamber.

If the compression device described above is used in an air conditioning system, the compressor is inserted in an external refrigerant circulation path. A refrigerant that is compressed by the compressor at high pressure is discharged from the compressor into the circulation path. In a compression device, in general, the pressure in its crank chamber can be autonomously adjusted. More specifically, the pressure in the crank chamber is feedback-controlled so that an actual differential pressure of the refrigerant between two given points in the external circulation path is equal to a target differential pressure. In consequence, the capacity of the compressor is varied by the pressure control in the crank chamber. More specifically, the actual differential pressure of the refrigerant is obtained from refrigerant pressures at two points between the compressor and a condenser, while the target differential pressure is settled according to external information from various external information detectors.

As mentioned before, the compression device autonomously adjusts the pressure in the crank chamber. Therefore, the compression device described in the aforesaid publication further comprises a refrigerant passage, through which some of the refrigerant discharged from the compressor is introduced into the crank chamber, and a solenoid valve inserted in the refrigerant passage.

The solenoid valve includes a valve body that adjusts the opening of the refrigerant passage. An electromagnetic force corresponding to the target differential pressure is applied to the valve body. On the other hand, the valve body is subjected to the aforesaid actual differential pressure of the refrigerant in the direction opposite to direction of the electromagnetic force. Thus, the refrigerant passage or the opening of the solenoid valve is adjusted in accordance with the electromagnetic force and the actual differential pressure. In consequence, the feed of the refrigerant into the crank chamber is adjusted, so that the pressure in the crank chamber (or the capacity of the compressor) can be feedback-controlled in accordance with the target differential pressure.

For the feedback control of the pressure in the crank chamber, the compression device described in the aforesaid publication uses the actual differential pressure of the refrigerant between two points in the external circulation path. In order to stabilize the feedback control, in this case, the actual differential pressure of refrigerant should be increased to a high level. To attain this, the compression device has a throttle that restrains the flow of the refrigerant between the two points in the circulation path. However, this throttle lowers the pressure of the refrigerant that is supplied from the compressor to the condenser, thereby causing a loss of the refrigerant pressure and lowering the efficiency of the air conditioning system.

SUMMARY OF THE INVENTION

The object of the present invention is to provide a swash-plate compression device of the variable capacity type, capable of autonomously adjusting the pressure in a crank chamber without lowering the discharge pressure of a fluid from a compressor.

The above object is achieved by a swash-plate compression device of a variable capacity type according to the present invention, which comprises: a swash-plate compressor of the variable capacity type including a rotatable swash plate, which is arranged in a crank chamber of the compressor and of which a tilt angle changes depending on the pressure in the crank chamber, and a plurality of pistons, which reciprocate individually in cylinder bores of the compressor as the swash plate rotates, thereby alternately increasing and reducing volumes of compression chambers defined in the cylinder bores, and executes a suction process, in which reciprocation of the pistons causes a fluid to be sucked into the compression chambers and a compression/discharge process, in which the fluid is compressed in the compression chambers and then the compressed fluid is discharged as a discharged fluid from the compression chambers; a fluid circuit for allowing the discharged fluid to be introduced into and released from the crank chamber; and a control valve in the fluid circuit for controlling and adjusting an actual discharge pressure of the discharged fluid to a target discharge pressure, the control valve including a valve body which is opened and closed to allow at least one of the introduction and release of the discharged fluid, urging means for urging the valve body in opening and closing directions, respectively, the urging means having a first urging force acting on the valve body in one direction according to an actual differential pressure between the actual discharge pressure of the discharged fluid and an internal pressure of the fluid in the compression chamber, and a second urging force acting on the valve body in the direction opposite to the one direction, the second urging force being settled based on a target differential pressure which is requested between the actual discharge pressure and the internal pressure of the fluid in accordance with the target discharge pressure, whereby the control valve autonomously adjusts the pressure in the crank chamber by means of the opening and closing of thereof in accordance with difference between the first and second urging forces so that the actual discharge pressure of the discharged fluid is feedback-controlled to be set to the target discharge pressure by means of the tilt angle of the swash plate determined by the autonomous adjustment.

According to the compression device described above, a high differential pressure can be generated between the actual discharge pressure of the discharged fluid and the internal pressure of the fluid in the compression chamber, so that the feedback control of the actual discharge pressure can be stably executed with use of the differential pressure. Thus, any throttle need not be inserted in a circulation path outside the compressor, so that a loss of pressure in the circulation path can be prevented.

Preferably, the internal pressure of the fluid is a mean internal pressure of the entire compression chambers or a peak internal pressure of the compression chamber.

More specifically, the fluid circuit includes an introduction passage, which is opened and closed by means of the control valve and through which some of the discharged fluid is introduced into the crank chamber, and a relief passage through which the pressure in the crank chamber is released to the low-pressure side, and the relief passage has an orifice.

In this case, the compressor further includes a suction chamber on the low-pressure side, which supplies the fluid to be compressed to the compression chamber, and the relief passage connects the crank chamber and the suction chamber.

Preferably, on the other hand, the control valve is a solenoid valve having a solenoid for applying the second urging force to the valve body.

The compressor may further comprise control means for settling the target discharge pressure of the discharged fluid, the control means including external information means, which obtains external information for settling a target capacity of the compressor as the target discharge pressure, and a controller for settling the target differential pressure in accordance with the target capacity, the controller having a memory stored with a correlation between the target capacity and the actual differential pressure.

If the actual differential pressure is obtained in accordance with the peak internal pressure of the compression chamber, that is, the peak value of the internal pressure, the external information means should preferably include a rotation sensor for detecting the rotational speed of the compressor.

More specifically, the compressor is provided with a discharge valve for discharging the discharged fluid from the compression chamber. Normally, the discharge valve is a reed valve, and the valve body of the discharge valve of this type easily sticks to a valve seat. This sticking delays opening of the discharge valve and causes fluctuation of the peak value of the internal pressure in the compression chamber. However, the fluctuation of the peak value can be estimated in accordance with the rotational speed of the compressor.

If the external information means includes the rotation sensor, therefore, a net peak value can be accurately obtained in accordance with the rotational speed of the compressor, and the feedback control can be executed with high accuracy.

A further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
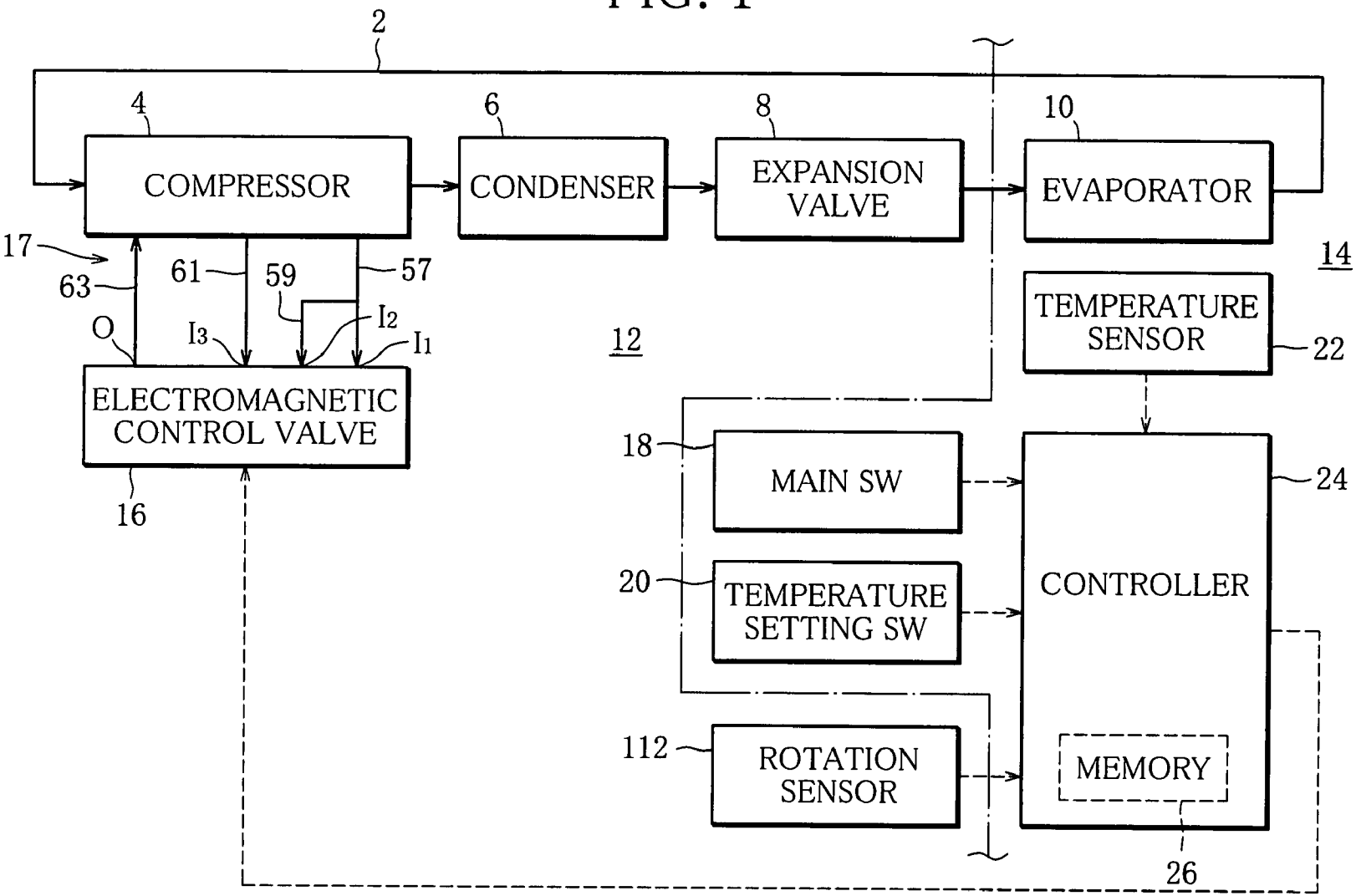
FIG. 1 is a block diagram of a refrigeration system furnished with a swash-plate compression device of the variable capacity type according to one embodiment of the invention.

Referring now to FIG. 1, there is shown an air conditioning system or refrigerating system for air-conditioning the interior space of a vehicle. The system comprises a circulation path 2, into which a swash-plate compressor 4 of the variable capacity type, condenser 6, expansion valve 8, and evaporator 10 are inserted successively in the direction of the flow of a refrigerant.

The path 2 extends between an engine room 12 and an interior space 14 of the vehicle, and the evaporator 10 is located in the space 14. More specifically, the evaporator 10 is located in a compartment that divides the engine room 12 and the space 14. A dashed line in FIG. 1 designates the boundary between the engine room 12 and the interior space 14.

Further, an electromagnetic control valve 16 is located in the engine room 12. The control valve 16 is connected to the compressor 4 through a fluid circuit 17, and is used for variable control of the discharge capacity of the compressor 4. More specifically, the control valve 16 has three inlets $I_1$, $I_2$ and $I_3$ and one outlet O for the compressor 4.

On the other hand, a control panel (not shown) for the air conditioning system is located in the interior space 14, and a main switch 18, a temperature setting switch 20, etc. of the air conditioning system are arranged on the control panel.

Further, a temperature sensor 22 is located near the evaporator 10. The sensor 22 detects the temperature of air in the interior space 14. The main switch 18, temperature setting switch 20, and temperature sensor 22 are connected electrically to a controller 24, and supply the controller 24 with switching signals and detection signals as external information.

The controller 24 includes a memory 26 therein. The memory 26 is previously stored with discharge characteristic information of the compressor 4. The discharge characteristic information will be mentioned later.

Based on the external information from the switches 18 and 20 and the temperature sensor 22 and the discharge characteristic information in the memory 26, the controller 24 supplies the control valve 16 with a command signal that settles a discharge capacity of the compressor 4.

Figure 2:
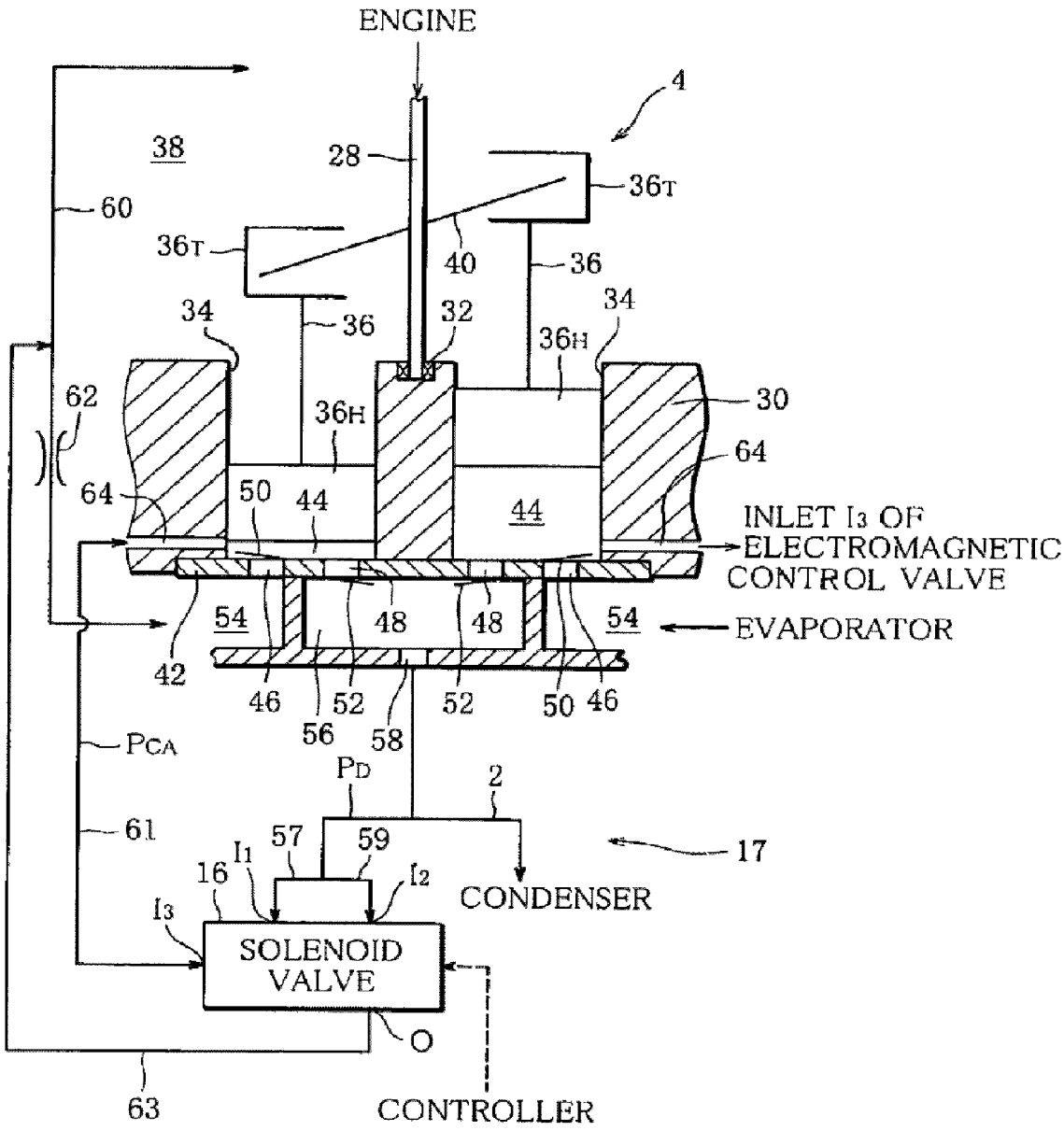
FIG. 2 is a sectional view schematically showing a part of a compressor shown in FIG. 1.

As shown in FIG. 2, the compressor 4 is provided with a main shaft 28, which has one end connected directly to an engine of the vehicle. Thus, the main shaft 28 is continually rotated by means of the engine. The other end of the main shaft 28 is rotatably supported on a cylinder block 30 by means of a bearing 32.

A plurality of cylinder bores 34 are formed in the cylinder block 30. These bores 34 are arranged at equal spaces in the circumferential direction of the cylinder block 30 and penetrate the block 30 in its axial direction.

A piston 36 is slidably fitted in each cylinder bore 34. The pistons 36 project into a crank chamber 38 on the main shaft side. A part of the inner wall of the crank chamber 38 is defined by one end face of the cylinder block 30.

On the other hand, a swash plate 40 is arranged in the crank chamber 38. The swash plate 40, which rotates integrally with the main shaft 28, is mounted on the shaft 28 so that the tilt angle of the swash plate 40 can be adjusted by means of pressure in the crank chamber 38. Each piston 36 has a tail $\mathbf{36}_T$ on its projected end, which nips the outer peripheral edge of the swash plate 40 with the aid of a pair of shoes (not shown). When the swash plate 40 is rotated together with the main shaft 28, therefore, the rotation of the plate 40 is converted into reciprocation of the pistons 36.

The inner end face or head $\mathbf{36}_H$ of each piston 36, in conjunction with a valve plate 42, defines a compression chamber 44 in each cylinder bore 34. The valve plate 42 is attached to the other end face of the cylinder block 30. The valve plate 42 has a suction hole 46 and a discharge hole 48 for each cylinder bore 34. Each of these holes 46 and 48 can be opened and closed by means of a suction valve 50 and a discharge valve 52. The valves 50 and 52 are reed valves.

The suction holes 46 communicate with a suction chamber 54, and the discharge holes 48 communicate with a discharge chamber 56. The discharge chamber 56 is located in the center of the cylinder block 30, while the suction chamber 54 is annular and surrounds the discharge chamber 56. The chambers 54 and 56 are defined independently of each other.

The discharge chamber 56 is connected to the circulation path 2 or the condenser 6 through a discharge port 58. The suction chamber 54 is connected to the path 2 or the evaporator 10 through a suction port (not shown).

Further, the suction chamber 54 is connected to the crank chamber 38 by means of a relief passage 60. An orifice 62 is located in the passage 60.

When the pistons 36 reciprocate as the swash plate 40 rotates, therefore, a suction process and a compression/discharge process are executed alternately. In the suction process, the refrigerant in the suction chamber 54 is sucked into the compression chamber 44 of each piston 36 via the suction valve 50. In the compression/discharge process, the refrigerant is compressed in the compression chamber 44, and thereafter, the compressed high-pressure refrigerant is discharged from the compression chamber 44 into the discharge chamber 56 via the discharge valve 52. In consequence, the compressor 4 can supply the refrigerant from the discharge chamber 56 to the condenser 6 through the discharge port 58.

As shown in FIG. 2, on the other hand, the discharge port 58 is also connected to the inlets $I_1$ and $I_2$ of the control valve 16 by means of passages 57 and 59, respectively. Further, the cylinder block 30 is formed having communication passages 64 that extend from the compression chambers 44, individually. These passages 64 communicate with one another and are connected to the remaining inlet $I_3$ of the valve 16 by means of a connecting passage 61. Furthermore, the outlet O of the control valve 16 is connected to the crank chamber 38 or that part of the relief passage 60 on the crank chamber side with respect to the orifice 62 by means of a passage 63.

Figure 3:
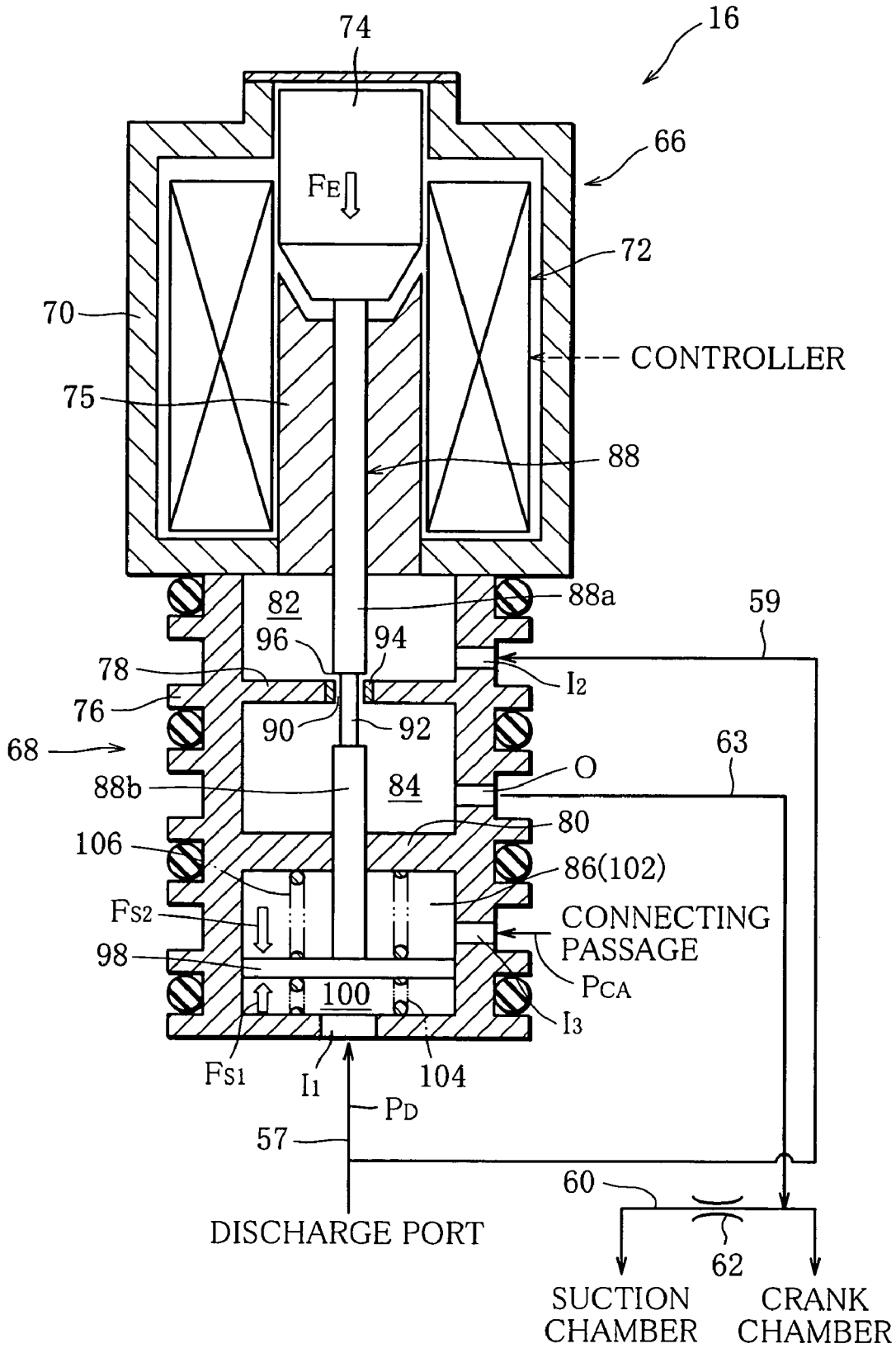
FIG. 3 is a longitudinal sectional view of a control valve shown in FIGS. 1 and 2.

FIG. 3 shows the control valve 16 more specifically.

The control valve 16 generally comprises an electromagnetic actuator 66 and a valve unit 68. The electromagnetic actuator 66 has a solenoid casing 70, which contains an electromagnetic solenoid 72 in the form of a hollow cylinder. The solenoid 72 is connected electrically to the controller 24, and is excited in accordance with a command signal from the controller 24.

A movable core 74 is located concentrically in the electromagnetic solenoid 72. When the solenoid 72 is excited, the movable core 74 is driven downward as in FIG. 3.

On the other hand, the valve unit 68 is provided with a cylindrical valve casing 76, which extends coaxially from the solenoid casing 70 and has one end coupled to the casing 70.

Two partition walls 78 and 80 are formed in the valve casing 76 and define three chambers 82, 84 and 86 in the casing 76. More specifically, as shown in FIG. 3, the top chamber 82 is formed as a refrigerant inlet chamber, and the chamber 84 that adjoins the inlet chamber 82 is formed as a refrigerant outlet chamber. The inlet $I_2$ and the outlet O are formed in the peripheral wall of the valve casing 76, and the inlet $I_2$ and the outlet O communicate with the refrigerant inlet and outlet chambers 82 and 84, respectively.

Further, a valve rod 88 is located concentrically in the valve casing 76. The rod 88 penetrates both the partition walls 78 and 80. The rod 88 also extends into the fixed core 75 of the electromagnetic actuator 66 and has one end coupled to the movable core 74. Thus, the valve rod 88 can move integrally with the movable core 74 in the axial direction of the valve rod 88.

The partition wall 80 has a through hole that is penetrated by the valve rod 88 for sliding motion. The partition wall 78 has a valve hole 90 that allows the passage of the rod 88. More specifically, the valve rod 88 has a small-diameter portion 92, which passes through the valve hole 90 with an annular gap therebetween. The small-diameter portion 92 divides the valve rod 88 into two parts, a large-diameter portion 88*a* that extends from the refrigerant inlet chamber 82 to the movable core 74 and a large-diameter portion 88*b* that extends from the refrigerant outlet chamber 84 to the chamber 86. Further, that opening edge of the valve hole 90 which faces the inlet chamber 82 is fitted in a valve seat 94, while that end portion of the large-diameter portion 88*a* which adjoins the small-diameter portion 92 is formed as a valve body 96 that cooperates with the valve seat 94. Thus, when the large-diameter portion 88*a* is moved from the position shown in FIG. 3 toward the partition wall 78, the valve body 96 engages the valve seat 94, thereby closing the valve hole 90.

On the other hand, a movable wall 98 is attached to the other end of the valve rod 88. The movable wall 98 airtightly divides the chamber 86 between first and second pressure chambers 100 and 102. The first pressure chamber 100 is situated near the other end or closed end of the valve casing 76 and has a first compression coil spring 104 therein. The spring 104 urges the movable wall 98 or the valve rod 88 toward the second pressure chamber 102. A second compression coil spring 106 is located in the second pressure chamber 102. The spring 106 urges the wall 98 or the rod 88 toward the first pressure chamber 100. An urging force $F_{s1}$ of the first spring 104 is greater than an urging force $F_{s2}$ of the second spring 106.

When the valve rod 88 is not driven by means of the movable core 74 of the electromagnetic actuator 66, therefore, the valve rod 88 is moved upward as in FIG. 3, so that the valve hole 90 is opened with a given opening. In this case, some of the high-pressure refrigerant that is supplied toward the condenser 6 through the discharge port 58 of the compressor 4 is introduced into the crank chamber 38 via the refrigerant inlet chamber 82, valve hole 90, and refrigerant outlet chamber 84.

Further, the inlet $I_1$ is formed in the closed end of the valve casing 76 and communicates with the first pressure chamber 100. The inlet $I_3$ is formed in the peripheral wall of the casing 76 and communicates with the second pressure chamber 102.

Thus, a discharge pressure $P_D$ of the high-pressure refrigerant that is supplied toward the condenser 6 through the discharge port 58 of the compressor 4 is introduced into the first pressure chamber 100. On the other hand, the pressure in the connecting passage 61 or the communication passages 64 is introduced into the second pressure chamber 102. As mentioned before, the passages 64 are connected to their corresponding compression chambers 44 of the compressor 4 and communicate with one another. Therefore, the pressure in the communication passages 64, that is, the pressure to be introduced into the second pressure chamber 102, is indicative of a mean internal pressure $P_{CA}$ for all the compression chambers 44. In consequence, the movable wall 98 of the valve rod 88 can receive an actual differential pressure $\Delta P_A$ or the difference between the discharge pressure $P_D$ and the mean internal pressure $P_{CA}$. The actual differential pressure $\Delta P_A$ can be obtained from $$\Delta P_A = P_D - P_{CA}.$$

The memory 26 of the controller 24 is previously stored with a correlation between the actual differential pressure $\Delta P_A$ and the delivery of the high-pressure refrigerant from the compressor 4 or the capacity of the compressor 4 as the aforesaid discharge characteristic information. This correlation may be obtained experimentally or theoretically.

The following is a detailed description of the operation of the compression device that comprises the compressor 4, control valve 16, controller 24, etc.

Let it first be supposed that the main shaft 28 of the compressor 4 is being rotated by means of the engine. In this state, the controller 24 settles a target discharge pressure or target capacity $Q_O$ of the compressor 4 in accordance with external information from the switches 18 and 20, temperature sensor 22, etc. Based on the discharge characteristic information in the memory 26 for the compressor 4, that is, the aforesaid correlation, thereafter, the controller 24 obtains a target differential pressure $\Delta P_O$ in accordance with the target capacity $Q_O$ (the target discharge pressure of the compressor 4). Then, the controller supplies the electromagnetic solenoid 72 of the valve 16 with a command signal corresponding to the target differential pressure $\Delta P_O$.

Thus, the electromagnetic solenoid 72 applies an electromagnetic force $F_E$ corresponding to the target differential pressure $\Delta P_O$ to the valve rod 88, whereupon the rod 88 is urged in a direction such that the valve body 96 closes the valve hole 90.

If the actual differential pressure $\Delta P_A$ that acts on the movable wall 98 of the valve rod 88 is lower than the target differential pressure $\Delta P_O$, a resultant force ($F_E$+$F_{S2}$) from the electromagnetic force $F_E$ and an urging force $F_{S2}$ of the second compression coil spring 106 is greater than a resultant force ($F_{\Delta P}$+$F_{S1}$) from an urging force $F_{S1}$ of the first compression coil spring 104 and an urging force $F_{\Delta P}$ that acts on the movable wall 98 in accordance with the actual differential pressure $\Delta P_A$. In this case, the valve rod 88 is moved in the direction to close the valve hole 90, whereupon the valve body 96 closes the valve hole 90. Accordingly, the communication between the refrigerant inlet chamber 82 and the refrigerant outlet chamber 84 of the control valve 16 is cut off, so that none of the high-pressure refrigerant that is discharged from the compressor 4 can be introduced into the crank chamber 38.

On the other hand, the crank chamber 38 continually communicates with the suction chamber 54 on the low-pressure side by means of the relief passage 60 (or orifice 62). Therefore, the pressure in the crank chamber 38 is released to the suction chamber 54 and lowered.

The reduction of the pressure in the crank chamber 38 causes the tilt angle of the swash plate 40 of the compressor 4 to increase, thereby lengthening the reciprocation stroke of each piston 36. Thus, the capacity of the compressor 4, that is, the discharge pressure $P_D$, is increased, so that the actual differential pressure $\Delta P_A$ rises toward the target differential pressure $\Delta P_O$.

If the actual differential pressure $\Delta P_A$ exceeds the target differential pressure $\Delta P_O$, thereafter, the resultant force ($F_{\Delta P}$+$F_{S1}$) becomes greater than the resultant force ($F_E$+$F_{S2}$). In this case, the valve rod 88 is moved in the direction to open the valve hole 90, whereupon the valve body 96 opens the valve hole 90, thereby causing the refrigerant inlet chamber 82 and the refrigerant outlet chamber 84 to communicate with each other. Accordingly, some of the high-pressure refrigerant that is supplied from the compressor 4 toward the condenser 6 is introduced into the crank chamber 38, and then the pressure in the chamber 38 increases.

This increase of the pressure in the crank chamber 38 reduces the tilt angle of the swash plate 40 and the reciprocation stroke of each piston 36, so that the discharge pressure $P_D$ of the compressor 4 and the actual differential pressure $\Delta P_A$ lower.

If the actual differential pressure $\Delta P_A$ becomes lower than the target differential pressure $\Delta P_O$ again, the introduction of the high-pressure refrigerant into the crank chamber 38 is stopped again, as mentioned before. As the pressure in the chamber 38 lowers, thereafter, the introduction of the refrigerant into the chamber 38 is restarted.

If the introduction of the high-pressure refrigerant into the crank chamber 38 is repeatedly started and stopped in this manner, the pressure in the chamber 38 is adjusted autonomously, and the actual differential pressure $\Delta P_A$ is feedback-controlled to be adjusted to the target differential pressure $\Delta P_O$. In consequence, the actual capacity of the compressor 4 is kept at the target capacity $Q_O$.

As seen from the above description, the actual differential pressure $\Delta P_A$ that is applied to the movable wall 98 is obtained from the difference between the discharge pressure $P_D$ and the mean internal pressure $P_{CA}$ for all the compression chambers 44, so that the actual differential pressure $\Delta P_A$ is higher than a differential pressure that is obtained between two points in the circulation path 2. Thus, with use of this actual differential pressure $\Delta P_A$, the actual capacity of the compressor 4 can be stably feedback-controlled to be adjusted to the target capacity $Q_O$.

According to the compression device of the present invention, the stable feedback control of the actual capacity never requires use of any throttle in the circulation path 2. In consequence, the air conditioning system that is furnished with the compression device of the invention can prevent a loss of pressure or lowering of the refrigerating efficiency that is attributable to the presence of a throttle in the circulation path 2.

The present invention is not limited to the compression device according to the one embodiment described above, and various modifications may be effected therein.

Figure 4:
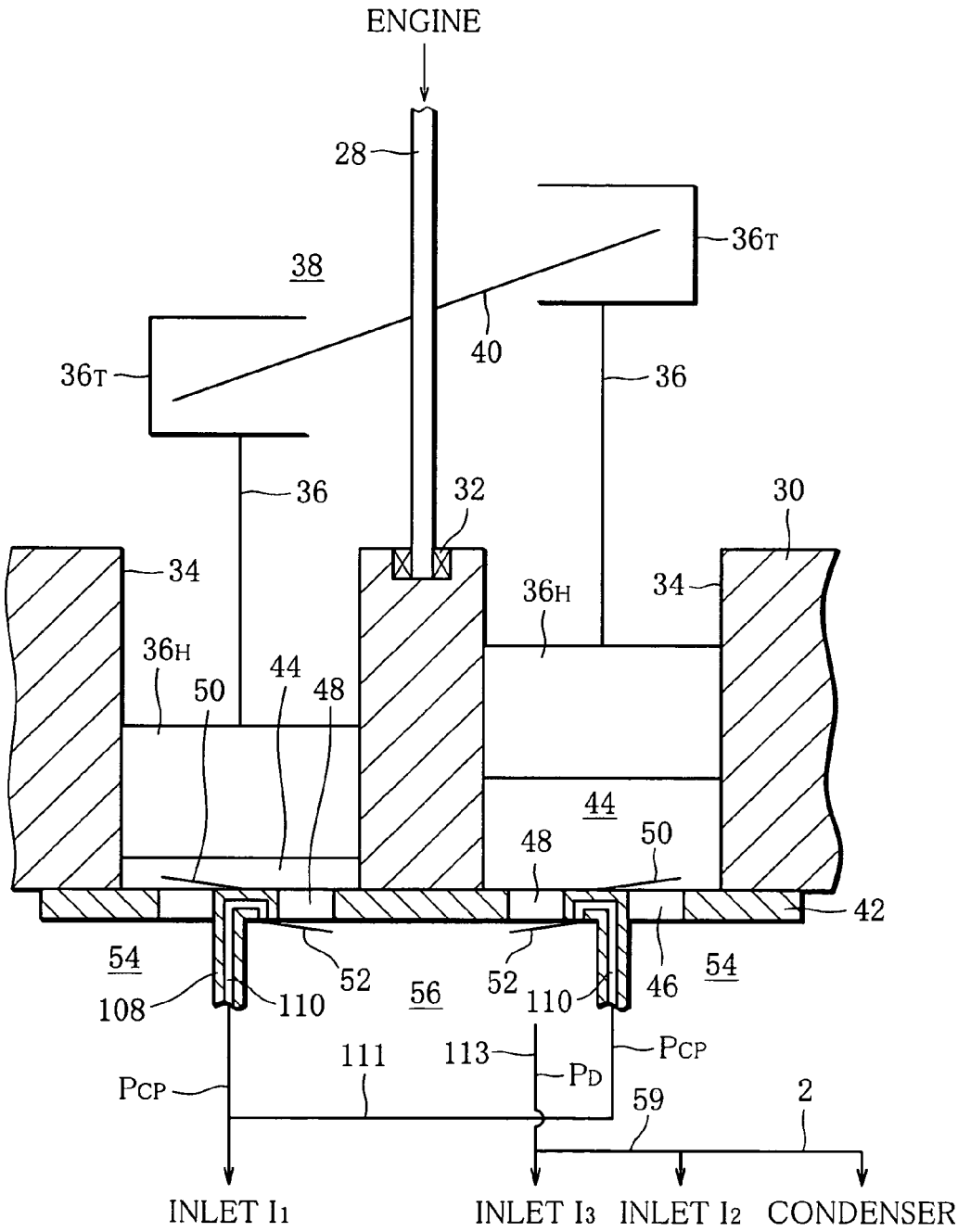
FIG. 4 is a sectional view schematically showing a part of a compressor according to another embodiment of the invention.

In a compression device according to another embodiment of the invention, as shown in FIG. 4, a peak internal pressure $P_{CP}$ and the discharge pressure $P_D$ can be introduced into the inlets $I_1$ and $I_3$, respectively, of the control valve 16, for example. More specifically, in the compressor 4, the partition wall 108 that divides the suction chamber 54 and the discharge chamber 56 are formed individually having communication passages 110 corresponding to the compression chambers 44. Each passage 110 has one end, which opens in the discharge chamber 56 in a position near its corresponding discharge hole 48 or at the root part of the discharge valve 52, and the other end, which is connected to the inlet $I_1$ by means of a passage 111. Each passage 110 transmits a peak value $P_V$ of an internal pressure $P_C$ of its corresponding compression chamber 44 to the inlet $I_1$. The peak value $P_V$ is obtained the moment the discharge valve 52 opens. On the other hand, the discharge chamber 56 is connected to the inlet $I_3$ by means of a passage 113.

In this case, the communication passages 64 are omitted, and an actual differential pressure $\Delta P'_A$ that acts on the movable wall 98 of the valve rod 88 can be obtained from $$\Delta P'_A = P_V - P_D.$$

The memory 26 of the controller 24 is previously stored with a correlation between the actual differential pressure $\Delta P'_A$ and the capacity (refrigerant delivery) of the compressor 4 as discharge characteristic information. This correlation may be also obtained experimentally or theoretically.

Even with use of the actual differential pressure $\Delta P'_A$ in place of the actual differential pressure $\Delta P_A$, the actual capacity of the compressor 4 can be stably feedback-controlled to be adjusted to the target capacity $Q_O$, as in the case of the foregoing embodiment.

If the actual differential pressure $\Delta P'_A$ is used, the discharge characteristic information should preferably cover the rotational speed of the compressor 4. To attain this, a rotation sensor 112 for detecting the rotational speed of the compressor 4 is connected electrically to the controller 24, as shown in FIG. 1.

The discharge characteristic information covers the rotational speed of the compressor 4 for the following reason.

Figure 5:
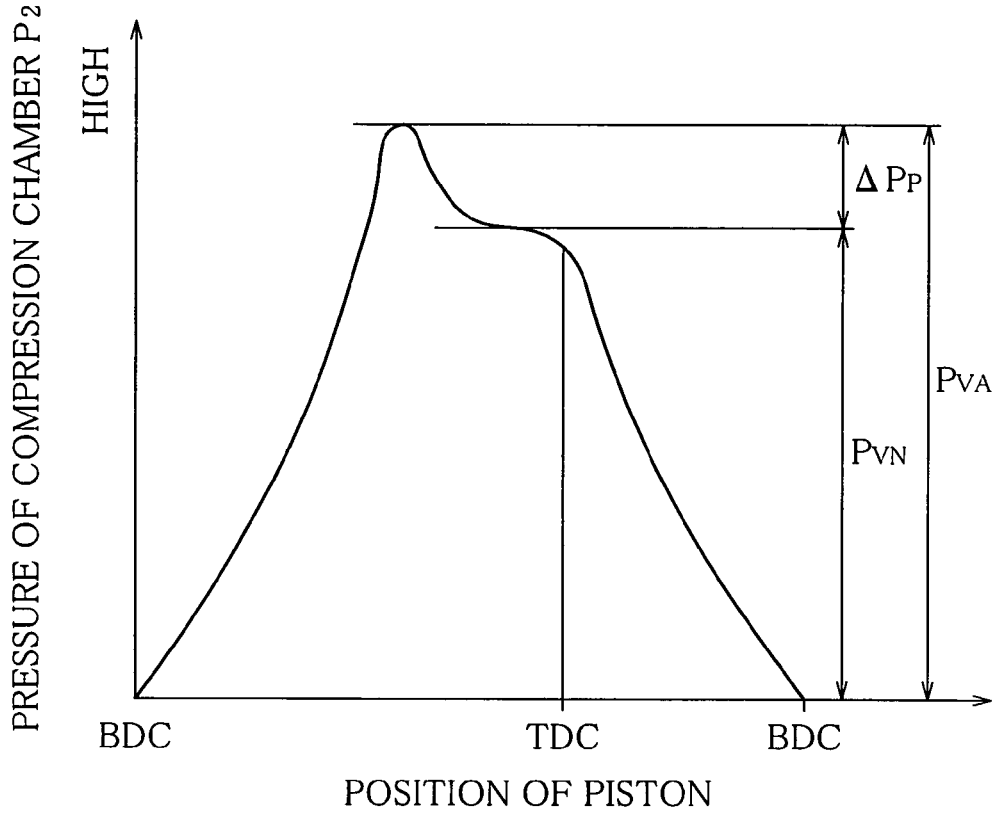
FIG. 5 is a graph showing change of pressure in a compression chamber caused when opening discharge valves of the compressor is delayed.

If a reed valve is used as each discharge valve 52 of the compressor 4, as mentioned before, the valve reed of the valve 52 may stick to the valve seat of the discharge hole 48, in some cases. The sticking valve reed delays opening of the discharge valve 52 and generates a transient peak deviation $\Delta P_P$ in the internal pressure $P_C$ of its corresponding compression chamber 44, as shown in FIG. 5. The peak deviation $\Delta P_P$ varies depending on the rotational speed of the compressor 4.

Therefore, the peak deviation $\Delta P_P$ or the rotational speed of the compressor 4 must be taken into consideration in order to obtain the correlation between the actual differential pressure $\Delta P'_A$ and the capacity of the compressor 4 accurately. More specifically, the actual differential pressure $\Delta P'_A$ that is used for the feedback control of the capacity of the compressor 4 must be obtained in accordance with a net peak value $P_{VN}$ ($=P_{VA}-\Delta P_P$), not with an apparent peak value $P_{VA}$ that is increased by the peak deviation $\Delta P_P$.

To attain this, the correlation ($\Delta P_P = f(N)$) between a rotational speed N of the compressor 4 and the peak deviation $\Delta P_P$ is obtained experimentally or theoretically in advance, and this correlation function f(N) is also stored in the memory 26 of the controller 24.

Thus, the actual differential pressure $\Delta P'_A$ can be obtained from $$\begin{aligned}\Delta P'_A &= P_{VN} - P_D \\ &= (P_{VA} - f(N)) - P_D.\end{aligned}$$

In this case, on the other hand, the controller 24 supplies the control valve 16 with a command signal that corresponds to the sum of the target differential pressure $\Delta P_O$ and the correlation function f(N).

If the actual capacity of the compressor 4 is feedback-controlled in accordance with the target capacity $Q_O$ using the actual differential pressure $\Delta P'_A$ obtained from the aforesaid equation, it can be kept at the target capacity $Q_O$ with high accuracy.

In the case of each embodiment described above, the pressure in the crank chamber 38 is adjusted as some of the high-pressure refrigerant that is discharged from the compressor 4 is introduced into the chamber 38 through the control valve 16. However, the pressure in the crank chamber 38 may be autonomously adjusted in a manner such that the high-pressure refrigerant in the crank chamber 38 is released through a control valve. In order to keep the pressure in the crank chamber 38 at a predetermined value, in this case, the high-pressure refrigerant is continually supplied from the compressor 4 to the crank chamber 38 without regard to the state, open or closed, of the control valve.

The control valve 16 may alternatively be a spool valve. In this case, the valve hole 90 may be omitted.

What is claimed is:

1. A swash-plate compression device of a variable capacity type, comprising:

a swash-plate compressor of the variable capacity type including a rotatable swash plate, which is arranged in a crank chamber of said compressor and of which tilt angle changes depending on pressure in the crank chamber, and a plurality of pistons, which reciprocate individually in cylinder bores of said compressor as the swash plate rotates, thereby alternately increasing and reducing volumes of compression chambers defined in the cylinder bores, and executes a suction process, in which reciprocation of the pistons causes a fluid to be sucked into the compression chambers, and a compression/discharge process, in which the fluid is compressed in the compression chambers and the compressed fluid is discharged as a discharged fluid from the compression chambers;

a fluid circuit which allows the discharged fluid to be introduced into and released from the crank chamber; and a control valve in said fluid circuit for controlling and adjusting an actual discharge pressure of the discharged fluid to a target discharge pressure, said control valve including a valve body which is opened and closed to allow at least one of the introduction and release of the discharged fluid, and urging means for urging the valve body in opening and closing directions, individually, the urging means having a first urging force acting on the valve body in one direction according to an actual differential pressure between the actual discharge pressure of the discharged fluid and an internal pressure of the fluid in the compression chamber, and a second urging force acting on the valve body in the direction opposite to the one direction, the second urging force being settled based on a target differential pressure which is requested between the actual discharge pressure and the internal pressure of the fluid in accordance with the target discharge pressure, whereby said control valve autonomously adjusts the pressure in the crank chamber by means of the opening and closing thereof in accordance with difference between the first and second urging forces so that the actual discharge pressure of the discharged fluid is feedback-controlled to be set to the target discharge pressure by means of the tilt angle of the swash plate determined by the autonomous adjustment.

2. The compression device according to claim 1, wherein the internal pressure of the fluid is a mean internal pressure of the entire compression chambers.

3. The compression device according to claim 1, wherein said fluid circuit includes an introduction passage, which is opened and closed by means of said control valve and through which some of the discharged fluid is introduced into the crank chamber, and a relief passage through which the pressure in the crank chamber is released to a low-pressure side, and the relief passage has an orifice.

4. The compression device according to claim 3, wherein said compressor further includes a suction chamber on the low-pressure side, which supplies the fluid to be compressed to the compression chamber, and the relief passage connects the crank chamber and the suction chamber.

5. The compression device according to claim 1, wherein said control valve includes a solenoid valve having a solenoid for applying the second urging force to the valve body.

6. The compression device according to claim 2, further comprises control means for settling the target discharge pressure of the discharged fluid, said control means including external information means, which obtains external information for settling a target capacity of said compressor as the target discharge pressure, and a controller for settling the target differential pressure in accordance with the target capacity, the controller having a memory stored with a correlation between the target capacity and the actual differential pressure.

* * * * *